US005934374A

United States Patent [19]

Hrametz et al.

[11] Patent Number: 5,934,374

[45] Date of Patent: Aug. 10, 1999

[54] FORMATION TESTER WITH IMPROVED SAMPLE COLLECTION SYSTEM

[75] Inventors: Andrew A. Hrametz, Rosenberg; James M. Moore; Mark A. Proett, both of Houston, all of Tex.

[73] Assignee: Halliburton Energy Services, Inc., Houston, Tex.

[21] Appl. No.: 08/691,125

[22] Filed: Aug. 1, 1996

[51] Int. Cl.[6] ..... E21B 49/10

[52] U.S. Cl. ..... 166/264; 166/66; 166/100

[58] Field of Search ..... 166/66, 100, 264

[56] References Cited

U.S. PATENT DOCUMENTS

| | | | |
|---|---|---|---|
| 2,601,122 | 6/1952 | McKinley . | |
| 2,674,313 | 4/1954 | Chambers . | |
| 2,681,110 | 6/1954 | Harrison | 166/55 |
| 2,776,013 | 1/1957 | Tausch | 166/150 |
| 2,982,130 | 5/1961 | McMahan . | |
| 3,009,518 | 11/1961 | Taylor et al. | 166/100 |
| 3,010,517 | 11/1961 | Lanmon, II | 166/100 |
| 3,011,554 | 12/1961 | Desbrandes et al. | 166/100 |
| 3,012,611 | 12/1961 | Haines | 166/147 |
| 3,022,826 | 2/1962 | Kisling, III | 166/100 |
| 3,035,440 | 4/1962 | Reed . | |
| 3,055,764 | 9/1962 | Pryor et al. | 166/109 |
| 3,075,585 | 1/1963 | Carlton et al. | 166/164 |
| 3,079,793 | 3/1963 | Le Bus et al. . | |
| 3,121,459 | 2/1964 | Van Ness, Jr. et al. . | |
| 3,127,933 | 4/1964 | Graham et al. . | |
| 3,134,441 | 5/1964 | Barry et al. | 166/187 |
| 3,177,938 | 4/1965 | Roussin . | |
| 3,190,360 | 6/1965 | Farley | 166/226 |
| 3,207,223 | 9/1965 | Hugel | 166/163 |
| 3,209,835 | 10/1965 | Bourne, Jr. et al. | 166/187 |
| 3,217,804 | 11/1965 | Peter | 166/63 |
| 3,217,806 | 11/1965 | Voetter | 166/163 |
| 3,248,938 | 5/1966 | Hill et al. . | |
| 3,253,654 | 5/1966 | Briggs, Jr. et al. | 166/100 |
| 3,254,531 | 6/1966 | Briggs, Jr. . | |
| 3,254,710 | 6/1966 | Jensen . | |
| 3,261,402 | 7/1966 | Whitten | 166/63 |
| 3,273,647 | 9/1966 | Briggs, Jr. et al. | 166/100 |
| 3,280,917 | 10/1966 | Kisling, III | 166/150 |
| 3,285,344 | 11/1966 | Jensen | 166/149 |
| 3,291,219 | 12/1966 | Nutter | 166/145 |
| 3,305,014 | 2/1967 | Brieger . | |
| 3,305,023 | 2/1967 | Farley | 166/226 |
| 3,306,102 | 2/1967 | Lebourg . | |
| 3,308,882 | 3/1967 | Lebourg . | |
| 3,308,887 | 3/1967 | Nutter | 166/150 |
| 3,319,718 | 5/1967 | Graff | 166/150 |
| 3,356,137 | 12/1967 | Raugust . | |
| 3,385,364 | 5/1968 | Whitten | 166/100 |
| 3,417,827 | 12/1968 | Smith et al. | 175/4.52 |
| 3,780,575 | 12/1973 | Urbanosky . | |
| 3,782,191 | 1/1974 | Whitten | 166/100 |

(List continued on next page.)

FOREIGN PATENT DOCUMENTS

| | | |
|---|---|---|
| 2172630 | 9/1986 | United Kingdom . |
| 2172631 | 9/1986 | United Kingdom . |

OTHER PUBLICATIONS

Waid, M.C., Proett, M.A., Chen, C.C., & Ford, W.T.; Improved Models for Interpreting the Pressure Response of Formation Testers; Society of Petroleum Engineers, Dallas, TX, 1991, pp. 889–904.

*Primary Examiner*—George A. Suchfield
*Attorney, Agent, or Firm*—Eugene R. Montalvo

[57] ABSTRACT

This invention provides a formation evaluation tool for collecting a formation fluid in a chamber at a predetermined pressure and for maintaining the pressure of the collected fluid at a desired level during the retrieval of the chamber to the surface. The formation fluid is pumped into the chamber while a piston exposed to the hydrostatic pressure maintains the chamber pressure at the hydrostatic pressure. During retrieval of the chamber, the pressure in the chamber is maintained at a predetermined level by pumping wellbore fluid to the piston. A control unit at the surface is utilized for controlling the operation of the formation tool.

30 Claims, 3 Drawing Sheets

U.S. PATENT DOCUMENTS

| | | | |
|---|---|---|---|
| 3,811,321 | 5/1974 | Urbanosky . | |
| 3,813,936 | 6/1974 | Urbanosky et al. . | |
| 3,858,445 | 1/1975 | Urbanosky . | |
| 3,859,850 | 1/1975 | Whitten et al. . | |
| 3,864,970 | 2/1975 | Bell . | |
| 3,924,463 | 12/1975 | Urbanosky . | |
| 3,934,468 | 1/1976 | Brieger . | |
| 3,952,588 | 4/1976 | Whitten . | |
| 4,063,593 | 12/1977 | Jessup . | |
| 4,210,018 | 7/1980 | Brieger | 166/100 |
| 4,369,654 | 1/1983 | Hallmark . | |
| 4,434,653 | 3/1984 | Montgomery | 166/100 |
| 4,513,612 | 4/1985 | Shalek . | |
| 4,739,654 | 4/1988 | Pilkington et al. . | |
| 4,843,878 | 7/1989 | Purfurst et al. . | |
| 4,860,580 | 8/1989 | DuRocher | 166/264 X |
| 4,860,581 | 8/1989 | Zimerman et al. | 175/50 |
| 4,879,900 | 11/1989 | Gilbert | 166/264 |
| 4,890,487 | 1/1990 | Dussan et al. . | |
| 4,936,139 | 6/1990 | Zimmerman et al. | 175/40 |
| 4,951,749 | 8/1990 | Carroll | 166/264 |
| 5,233,866 | 8/1993 | Desbrandes . | |
| 5,266,800 | 11/1993 | Mullins . | |
| 5,269,180 | 12/1993 | Dave et al. . | |
| 5,279,153 | 1/1994 | Dusan et al. | 166/100 |
| 5,303,775 | 4/1994 | Michaels et al. | 166/264 |
| 5,335,542 | 8/1994 | Ramakrishnan et al. . | |
| 5,341,100 | 8/1994 | Taylor . | |
| 5,377,755 | 1/1995 | Michaels et al. | 166/264 |
| 5,473,939 | 12/1995 | Leder et al. | 166/264 X |
| 5,587,525 | 12/1996 | Shwe et al. | 166/264 X |

FORMATION TESTER WITH IMPROVED SAMPLE COLLECTION SYSTEM

BACKGROUND OF THE INVENTION

1. Field of the Invention

This invention relates generally to formation fluid testing and collection apparatus and more particularly to a modular formation tester having a formation fluid collection system that collects formation fluids at a predetermined pressure and maintains the collected fluid pressure at such pressure throughout the logging operations.

2. Description of the Related Art

In the oil and gas industry, wireline formation testing tools have been used for monitoring formation pressures along a wellbore, obtaining formation fluid samples from the wellbore and for predicting performance of reservoirs around the wellbore. Such formation testing tools typically contain an elongated body having an elastomeric packer that is sealingly urged against the zone of interest in the wellbore to collect formation fluid samples in storage chambers placed in the tool.

During drilling of a wellbore, a drilling fluid ("mud") is used to facilitate the drilling process and to maintain a hydrostatic pressure in the wellbore greater than the pressure in the formations surrounding the wellbore. The drilling fluid penetrates into or invade the formations for varying radial depths (referred to generally as the invaded zones) depending upon the types of the formation and drilling fluid used. The formation testing tools retrieve formation fluids from the desired formations or zones of interest, test the retrieved fluids to ensure that the retrieved fluid is substantially free of mud filtrates and collect such fluids in one or more chambers associated with the tool. The collected fluids are brought to the surface and analyzed to determine properties of such fluids and to determine the conditions of the zones or formations from where such fluids have been collected. It is, therefore, critical that only uncontaminated fluids are collected in the same condition in which they exist in the formation.

However, the prior art formation tester tools typically collect the retrieved formation by transferring such fluids from a probe into one or more chambers with restrictions to slow down the fluid flow rate into such chambers at nearly atmospheric pressure. Frequently water cushions are utilized to fill the chambers more uniformly. In order to not allow the fluid entering into the chamber to flash or to reduce the chances of vaporizing any liquid gas, the formation fluid is pumped into the chamber at a relatively slow rate. Still, it is common for the collected fluid to contain vaporized gas. Additionally, asphaltenes are commonly present in the hydrocarbons and if the pressure in the chamber remains at a relatively low pressure, such asphaltenes tend to flocculate to form gel-type masses in the fluid. The flocculation process is substantially irreversible. Thus, it is desirable not only to withdraw the formation fluids above the bubble point but also to collect the fluids at a pressure in the chambers that is above the bubble point and above the asphaltene flocculation pressure.

Additionally, the temperature difference between the surface temperature and the formation can exceed several tens of degrees fahrenheit. As the tool is retrieved, the chamber temperature drops, causing the pressure in the chamber to drop accordingly. A substantial pressure drop in the chamber can significantly change the condition of the collected fluid. The ideal condition is that in which the fluid is collected and maintained at a pressure that is above the bubble point pressure and the asphaltene flocculation pressure throughout logging operations.

The present invention addresses the above-noted problems and provides a formation tester in which the uncontaminated formation fluid is collected in a chamber maintained at a predetermined pressure above the bubble point. No water cushions are required to uniformly fill the chambers. The tool also automatically maintains the chamber pressure at the predetermined pressure during the entire logging operation regardless of the change in the temperature surrounding the chamber.

SUMMARY OF THE INVENTION

This invention provides a closed-loop system for retrieving formation fluid from a zone of interest in a wellbore, determining the type (single phase or multiple phase) of the formation fluid, determining the bubble point pressure of the retrieved fluid, and collecting fluid samples in a chamber wherein the pressure in the chamber is maintained above the formation pressure during the collection of the formation fluid and during the retrieval of the chamber from the wellbore.

The closed loop system of the present invention contains a downhole tool which has at least one probe that is adapted to be sealingly placed against the wellbore formation. A pump coupled to the probe controls the flow of the formation fluid from the formation into a flow line. A fluid analysis device determines when the fluid in the flow line is substantially free from mud filtrates. The clean formation fluid is collected in a collection chamber. The collection chamber is divided into two sections by a piston. The first section is placed in fluid communication with the flow line for receiving fluid therefrom, while the second section is maintained at the wellbore hydrostatic pressure. A first fluid flow control device controls the fluid flow from the flow line to the first section. Before collecting the fluid in the first section, the piston is fully inserted due to the hydrostatic pressure in the second section. To collect the fluid in the first section, the pump is energized, and the first fluid control device is opened causing the pressure in the first section to exceed the hydrostatic pressure, thereby filling the chamber with the fluid from the flow line. During the filling process, the back pressure on the piston remains at the hydrostatic pressure, which ensures the collection of the fluid in the chamber remains above the formation pressure.

In another embodiment of the collection chamber, a second fluid flow control device is provided between the second section and the wellbore fluid for controlling the fluid flow from the wellbore to the second section. A third fluid flow control device is provided between the flow line and the second section. After the chamber has been filled to a desired level, the first and second fluid flow control devices are closed and the third fluid flow control device is opened. The pump is energized to inject the fluid from the flow line into the second section to maintain the back pressure in the second section at a predetermined level.

This invention provides a novel method for retrieving and collecting formation fluids from a zone of interest in a wellbore at the original formation conditions. The method of the invention contains the steps of: (a) sealingly placing a probe against the zone of interest in the wellbore for receiving the formation fluid; (b) controllably allowing the fluid to pass from the probe into a flow line; (c) determining when the fluid in the flow line is substantially free from mud filtrates; (d) controllably passing the substantially mud filtrate free fluid into a chamber while maintaining the pressure in the chamber at the hydrostatic pressure of the wellbore; and (e) retrieving the chamber from the wellbore while maintaining the pressure in the chamber a predetermined pressure.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1:
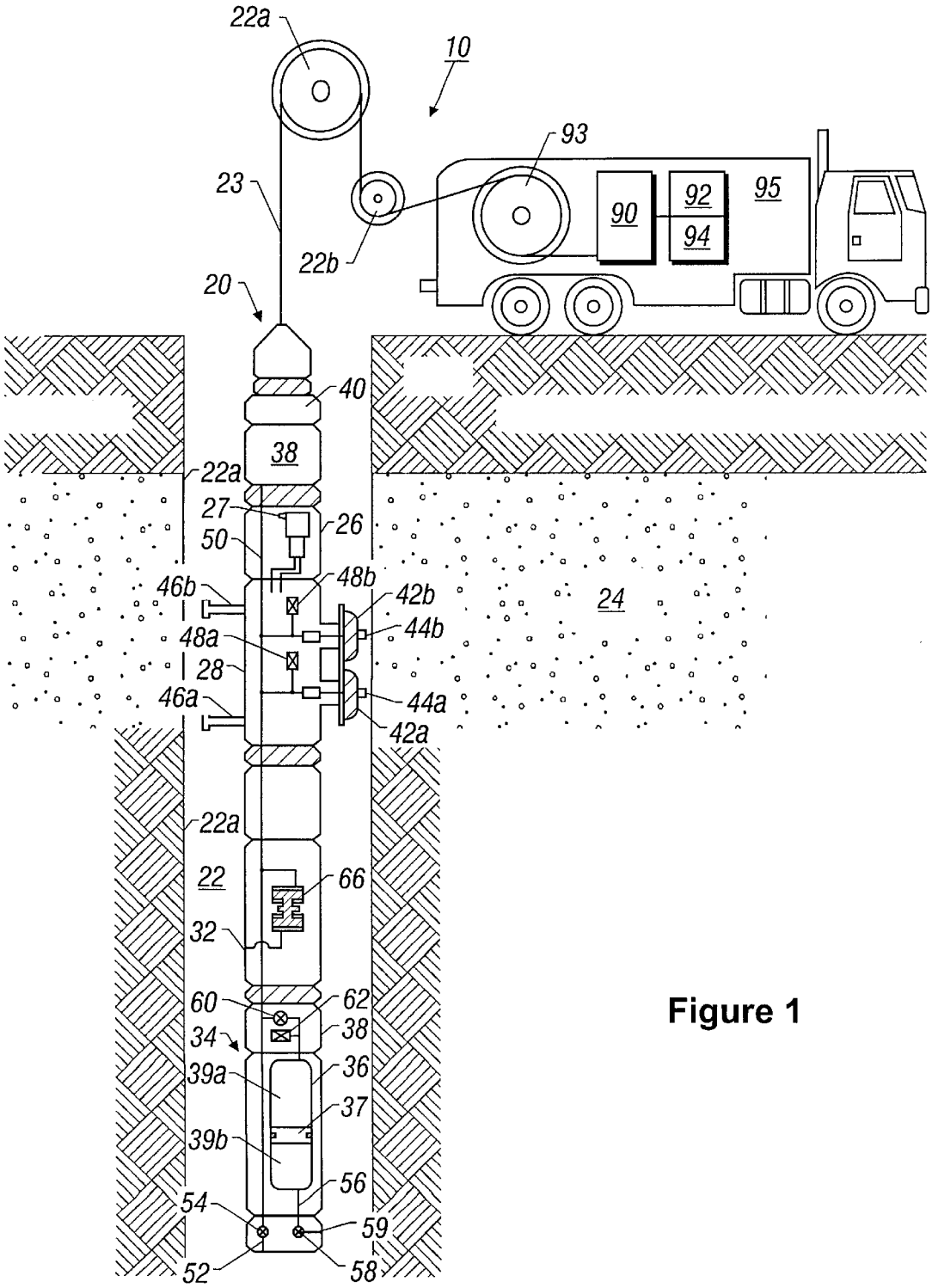
FIG. 1 shows a schematic elevational view of a formation evaluation system with a formation tester according to one embodiment of the present invention conveyed in a wellbore for testing and retrieving formation fluids.

FIG. 1 shows an embodiment of a wireline formation evaluation and testing system 10 having a downhole formation evaluation and testing tool or apparatus 20 conveyed in a wellbore 22 by a wireline 23 for testing and retrieving formation fluids from a desired selected formation 24 within the wellbore 22 according to the normal operation of the system 10. The tool 20 contains a number of serially coupled modules, each module designed to perform a particular function. The type of modules and their order is changeable based on the design needs. In the embodiment of FIG. 1, the tool 20 includes a sequential arrangement of an electro-hydraulic system 26, a packer/probe module 28, a fluid testing module 32 and a sample collection module 34, which is comprised of a chamber 36 and a control section 38. The tool 20 also contains a control section 38 that contains downhole electronic circuitry and a two-way telemetry section 40.

The tool 20 is conveyed in the wellbore 22 by the wireline 23 which contains conductors for carrying power to the various components of the tool and conductors or cables (coaxial or fiber optic cables) for providing two-way data communication between the tool 20 and a control unit 90, which is placed uphole (on the surface) in a suitable truck 95 for land operations and in a cabin (not shown) for offshore operations. The wireline 23 is conveyed by a drawworks 93 via a system of pulleys 22*a* and 22*b*.

The control unit 90 contains a computer and associated memory for storing therein desired programs and models. The control system 90 controls the operation of the tool 20 and processes data received from the tool 20 during operations. The control unit 90 has a variety of associated peripherals, such as a recorder 92 for recording data and a display or monitor 94 for displaying desired information. The use of the control unit 90, display 94 and recorder 92 is known in the art of well logging and is, thus, not explained in greater detail herein.

Still referring to FIG. 1, the packer section 28 contains one or more inflatable packers such as packers 42*a* and 42*b* respectively having probes 44*a* and 44*b*. During operations, the packers 42*a* and 42*b* are urged against a desired formation, such as formation 24, by urging back-up pads 46*a* and 46*b* against the wellbore wall 22*a* opposite the packer 42*a* and 42*b*. The electro-hydraulic section 26 preferably contains a pump 27 for inflating the packers 42*a* and 42*b*. The packers 42*a* and 42*b* provide a seal to their respective probes 44*a* and 44*b* which embed into formation 24. The electro-hydraulic section 26 deploys backup pads 46*a* and 46*b*, which causes the packers 42*a* and 42*b* to urge against the wellbore wall 22*a*. The system urges 10 the packers 42*a* and 42*b* until a seal is formed between the packers and the wellbore wall 22*a* to ensure that there is a proper fluid communication between the wellbore formation 24 and the probes 44*a* and 44*b*. Any other suitable means may also be used for deploying the packers 42*a* and 42*b* for the purposes of this invention. The probes 44*a* and 44*b* radially extend away from the tool body and penetrate into the formation 24 when the packers 42*a* and 42*b* are urged against the wellbore interior wall 22*a*. The packer section 26 also contains pressure gauges 48*a* and 48*b* to monitor pressure changes during fluid sample collection process respectively from the probes 44*a* and 44*b*.

The flushing pump 27 controls the formation fluid flow from the formation 24 into a flow line 50 via the probes 44*a* and 44*b*. The pump operation is preferably controlled by the control unit 90 or by the control circuit 38 placed in the formation tester tool 20. The fluid from the probes 44*a* and 44*b* flows through the flow line 50 and may be discharged into the wellbore via a port 52. A fluid control device, such as control valve, 54 may be connected to the flow line for controlling the fluid flow from the flow line 50 into the wellbore 22. The fluid testing section 32 contains a fluid testing device 66 which analyzes the fluid flowing through the flow line 50. For the purpose of this invention, any suitable device or devices may be utilized to analyze the fluid. A number of different devices have been used to determine certain downhole parameters relating to the formation fluid and the contents (oil, gas, water and solids) of the fluid. Such information includes the drawdown pressure of fluid being withdrawn, fluid density and temperature.

The chamber section 34 contains at least one collection chamber, such as chamber 36. The chamber 36 preferably contains a piston 37 that divides the chamber 36 into a top chamber or section 39*a* and a bottom chamber or section 39*b*. A conduit 56 is coupled to the bottom chamber 39*b* to provide fluid communication between the bottom chamber 39*b* and the outside environment such as the wellbore 22, via a post 59*a*. A fluid flow control device 58, such as an electrically controlled valve, placed in the conduit 56 is selectively opened, and closed to allow fluid communication between the bottom chamber 39*b* and the wellbore 22 as desired. The chamber section 34 also contains a fluid flow control device 60, such as an electrically operated control valve, which is selectively opened and closed to direct the formation fluid from the flow line 50 into the upper chamber 39*a*. When the control valve 60 is closed, the fluid from the flow line 50 is discharged into wellbore 22. The control valve 60 may be controlled by the downhole control circuit 38 or from the surface by the control unit 90. A pressure sensor 62 (P3) is placed in the flow line 50 to detect pressure in the upper section 39*a* of the chamber.

To operate the system 10 of the present invention, the tool 20 is conveyed into the wellbore 22 by means of the wireline 23 or another suitable means, such as a coiled tubing, to a desired location ("depth"). The packers 42*a* and 42*b* are urged against the wellbore wall 22*a* at the zone of interest 24. The electro hydraulic system 26 deploys the packers 42*a* and 42*b* and backup pads 46*a* and 46*b* to create a hydraulic seal between the elastomeric packers 42*a* and 42*b* and the formation 24. Once the packers are set, a pretest is performed. To perform this pretest, the pump 27 is used to draw a small sample of the formation fluid into the flow line 50 of the tool 20 while the flow line 50 is monitored using a high accuracy quartz pressure gauge. As the fluid sample is drawn into the flow line 50, the pressure decreases due to the resistance of the formation 24 to fluid flow. When the pretest stops, the pressure in the flow line 50 increases until it equalizes with the pressure in the formation 24. This is due to the formation 24 gradually releasing the fluids into the probes 44*a* and 44*b*. The formation pressure is typically lower than the pressure in the wellbore 22 (the hydrostatic pressure) and this difference is used as a means for verifying that the packers 42*a* and 42*b* are sealed against the wellbore wall 22*a*. The fluids in the pore space of the formation 24 near the probes 44*a* and 44*b* are typically invaded with mud filtrates.

As noted earlier, the initial fluid drawn from the formation 24 typically contains mud filtrates which have invaded into the formation 24. It is, therefore, important that the formation fluids collected downhole be uncontaminated (clean fluid) and in the same physical conditions in which such fluids are present in the formation. For example, the gas and oil contents of the fluid should be maintained in the manner present in the formation during the collection process. This requires determining when the fluid flowing through the flow line is substantially free of mud filtrates and collecting the fluid above the bubble point pressure of the fluid. Various devices have been utilized for determining the downhole conditions of the fluid during the collection process and to control the flow rate to maintain the fluid pressure above the bubble point. Such devices include resistivity devices, pressure differential devices, acoustic devices and optical devices. Any such device or any other suitable device may be utilized for the purpose of this invention.

To determine the bubble point pressure, the formation fluid flow rate into the flow line 50 is slowly increased by controlling the flush-pump 27 while continuously monitoring one or more fluid parameters, such as the density, optical absorption, etc. As the fluid rate is increased, the gas in fluid, if present, expands into a gaseous state from its normal liquid state, which is observed as a change in the fluid parameter, which in the case of the density measurement is a decrease in the density value. The pressure at which such fluid parameter changes typically is the bubble point pressure of the fluid. To ensure the accuracy of the results, the flow rate is decreased until the parameter suddenly rises to the initial value of the clean fluid and the corresponding fluid pressure. The procedure may be repeated if necessary to accurately determine the bubble point pressure.

To collect the fluid samples in the condition in which such fluid is present in the formation 24, the area near the probes 44*a* and 44*b* is flushed or pumped. The pumping rate of the flushing pump 27 is regulated such that the pressure in the flow line 50 near the probes is maintained above the bubble point of the fluid sample. While the flushing pump is running, the fluid testing device 66 measures the fluid properties. The device 66 preferably provides information about the contents of the fluid and the presence of any gas bubbles in the fluid to the surface control unit 90. By monitoring the gas bubbles in the fluid, the flow in the flow line 50 can be constantly adjusted so as to maintain a single phase fluid in the flow line 50. These fluid properties and other parameters, such as the pressure and temperature, can be used to monitor the fluid flow while the formation fluid is being pumped for sample collection. When it is determined that the formation fluid flowing through the flow line 50 is representative of the in situ conditions, the fluid is then collected in the fluid chamber 36 as described below.

When the tool 20 is conveyed into the wellbore 22, the control valve 58 remains open, allowing the wellbore fluid to enter the lower section 39*b*. This causes the piston 37 to move inward, filling the lower sections 39*b* with the wellbore fluid. This is because the hydrostatic pressure at the port 59 is greater than the pressure in the flow line 50. Alternatively, the piston 37 may be set at the fully inserted position at the surface and the lower chamber 39*b* allowed to be filled with the wellbore fluid after the tool 20 has been positioned in the wellbore. To collect the formation fluid in the chamber 36, the valve 54 is closed, valve 60 is opened and the pump 27 is operated to pump the formation fluid into the flow line 50. As the pump continues to operate, the flow line pressure continues to rise. When the flow line pressure exceeds the hydrostatic pressure (pressure in the chamber 39*b* or the back pressure), the formation fluid starts to fill in the upper chamber 39*a*. The pump rate is controlled so as to maintain the pressure as determined by the pressure sensor 62 at level that will ensure that the pressure of the collected fluid in the fluid chamber remains above the bubble point or at any other desired value. When the upper chamber 39*a* has been filled to a desired level, the valves 58 and 60 are closed, which ensures the pressure in the chamber 39*a* remains at the pressure at which the fluid was collected therein.

Figure 2:
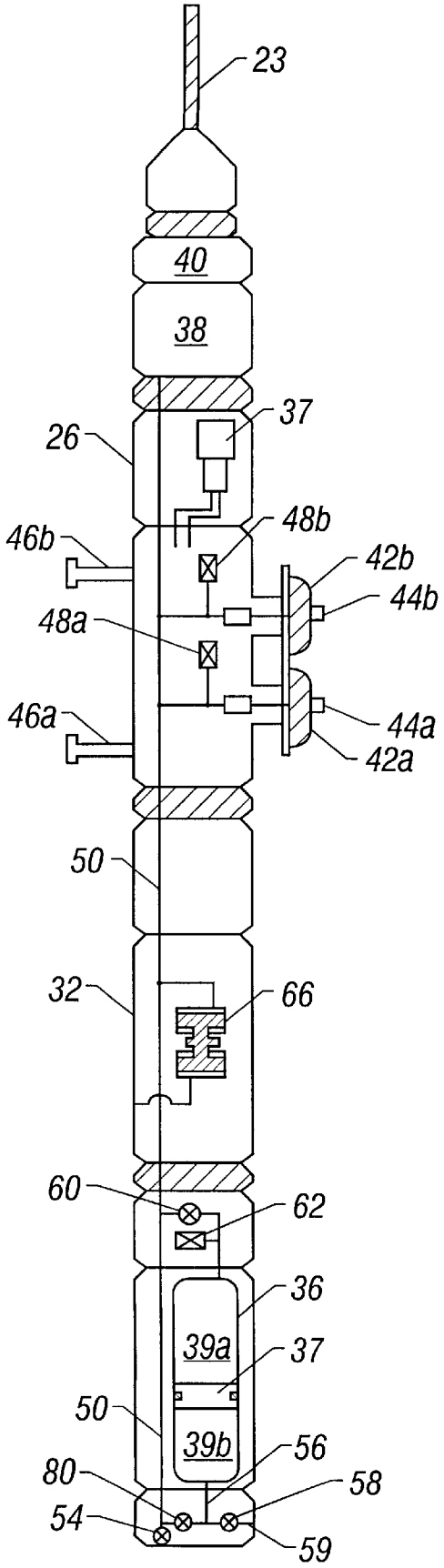
FIG. 2 shows a schematic elevational view of an alternative embodiment of the formation tester according to the present invention for use in the system of FIG. 1.

FIG. 2 shows an alternative embodiment of the collection chamber 36. In this embodiment, a control valve 80 is connected between the flow line 50 and the fluid line 56. To collect the formation fluid into the chamber 36, the control valve 80 is closed, valves 58 and 60 are opened and the chamber 39*a* is filled as described earlier with respect to FIG. 1.

In some applications, the tool temperature drops considerably from the downhole location to the surface as the tool is retrieved after collecting the fluid sample, possibly causing the pressure in the chamber 36 to drop below the bubble point or below a predetermined value. The chamber configuration of FIG. 2 allows the operator to maintain the pressure in the collection chamber 36 at any desired level, even with a substantial drop in the chamber pressure due to change in chamber temperature when the tool 20 is retrieved from a high temperature downhole location to the surface. To maintain the pressure in the chamber 39*a* at the desired level, the control valves, 54, 59 and 60 are closed while the valve 80 is opened. The pump 27 or any other suitably placed pump is utilized to pump the wellbore fluid into the flow line 50 via the ports 44*a* and 44*b*. The wellbore fluid enters the lower chamber 39*b* via the line 56. The pressure sensor 62 continuously detects the pressure of the fluid in the chamber 39*a*. The operation (speed) of the pump is controlled so as to maintain the pressure in the upper chamber 39 at a desired level. As noted earlier, the operation of the tool 20, including the operation of the various control valves and the pumps may be controlled by the surface control unit 90 or by a microprocessor based control circuit 38 placed in the tool.

Figure 3:
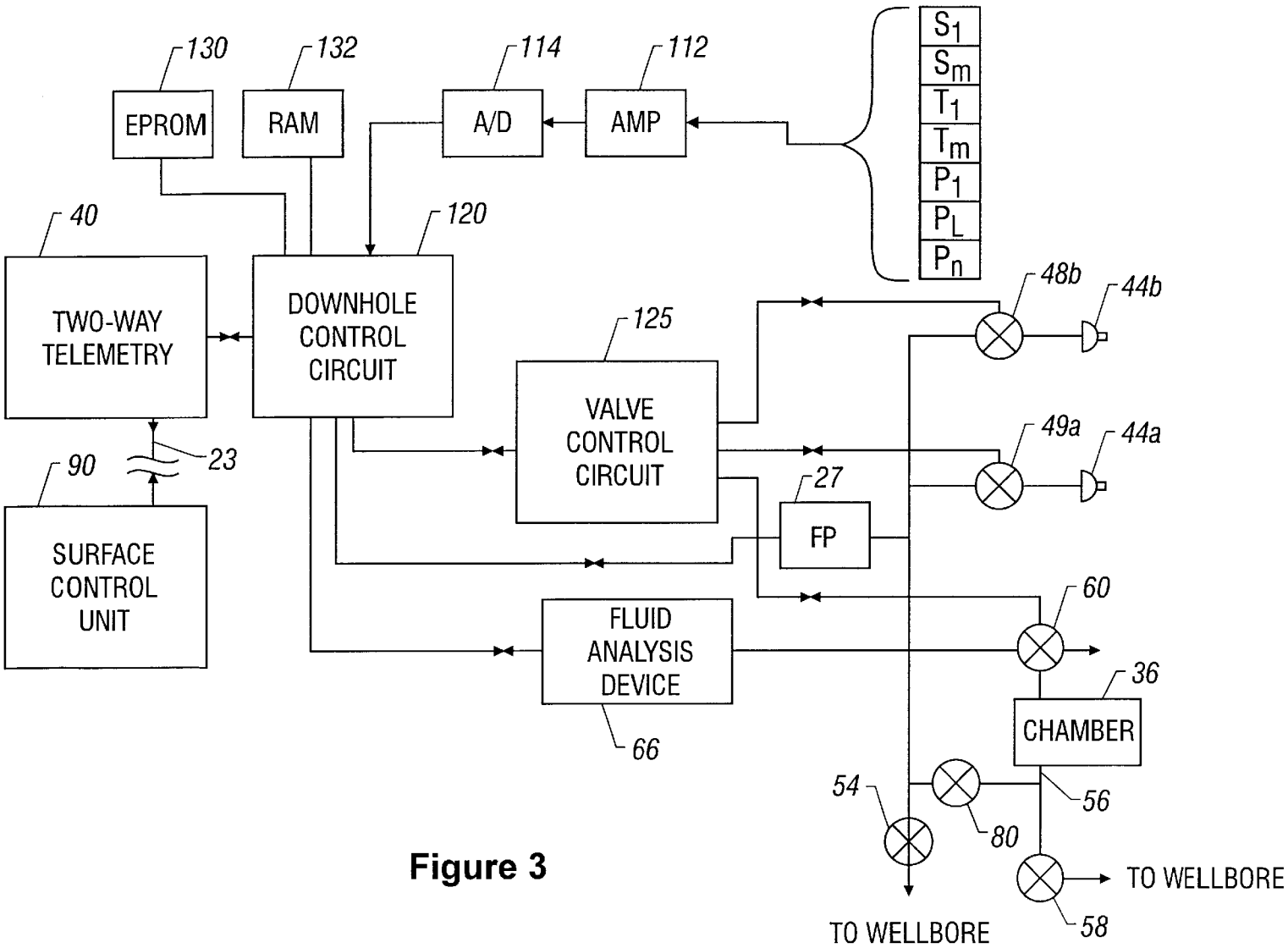
FIG. 3 shows a functional block diagram of a control system for operating the formation evaluation system of FIG. 1.

The operation of the preferred embodiment of the downhole control circuit 38 and the surface control unit 90 will now be described while referring to FIGS. 1–3. Referring to FIG. 3, the signals from the various pressure sensors $P_1$–$P_r$ (48*a*, 48*b*, 62, etc.) and temperature sensors ($T_1$–$T_n$) and other sensors ($S_1$–$S_m$) are amplified by one or more pre-amplifiers, such as the amplifier 112, digitized by an associated analog-to-digital (A/D) converter, such as A/D converter 114, and passed to a downhole microprocessor based circuit 120. The circuit 120 is coupled to the fluid analysis unit 66 for processing data received from the unit and for controlling the operation of such unit. The control circuit 120 controls the operation of each of the pumps in the tool 20 as well as the operation of each of the electrically control fluid control device (valves) 54, 58, 60 and 80 via a valve control circuit 125.

The programs or instructions for the downhole circuit 120 are stored in a programmable read only memory (EPROM) 130. A random access memory (RAM) associated with the micro-controller circuit 125 is used for storing data downhole. The circuit 125 communicates with the surface control unit 90 via the downhole two-way telemetry 40. During operations, the surface control unit 90 provides instructions to the downhole circuit 125, which in turn controls the operations of the various devices downhole. The circuit 125 transmits data to the surface control unit 90 via the two-way telemetry 40. An operator stationed at the surface typically operates the surface control unit 90. The desired information about the tool operation including the collection of the formation fluid, formation characteristics and downhole parameters are displayed on the monitor 94 while the data is recorded in the recorder 92.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A formation tester tool for retrieving a fluid from a selected formation from within a wellbore having a wellbore fluid therein, comprising:

(a) a device for retrieving formation fluid from the selected formation;

(b) a fluid collection chamber having a first chamber for receiving the formation fluid and a second chamber in fluid communication with the wellbore for maintaining a back pressure in the second chamber;

(c) a pressure sensor associated with the first chamber for detecting the pressure in the first chamber.

2. The apparatus according to claim 1, wherein a piston in the collection chamber separates and defines the first and second chambers.

3. The apparatus according to claim 2, wherein the second chamber is in fluid communication with the outside environment.

4. The apparatus according to claim 3 further having a first fluid flow control device associated with the first chamber for controlling the flow of the formation fluid into the first chamber.

5. The apparatus according to claim 4 further having a second fluid flow control device associated with the second chamber for controlling the fluid flow from the wellbore into the second chamber.

6. The apparatus according to claim 4, wherein the device for retrieving the formation fluid discharges the retrieved formation fluid into a flow line.

7. The apparatus according to claim 6, wherein the device for retrieving the formation fluid controls the flow of the retrieved fluid into the flow line so as to maintain the pressure in the flow line above the bubble point of any gas contained in the formation fluid.

8. The apparatus according to claim 7 further having a fluid analysis device for determining when the formation fluid in substantially free from mud filtrates.

9. The apparatus according to claim 8, wherein the first flow control device is placed between the flow line and the first chamber for selectively discharging the formation fluid from the flow line into the first chamber.

10. The apparatus according to claim 9, wherein the device for retrieving formation fluid includes a pump for pumping the retrieved formation fluid into the flow line.

11. The apparatus according to claim 9 further having a control circuit for controlling the operation of the fluid flow control devices.

12. The apparatus according to claim 9 further having a third fluid flow control device placed between the flow line and the second chamber for controlling the fluid flow from the flow line into the second chamber.

13. The apparatus according to claim 12 further having a fourth fluid flow control valve placed in the flow line for controlling the fluid flow from the flow line into the outside environment.

14. A formation tester for testing and retrieving a formation fluid from a selected formation around a wellbore having a hydrostatic pressure due to the presence of a wellbore fluid therein, comprising:

(a) a probe adapted for placement against the selected formation for withdrawing the formation fluid into a flow line;

(b) a pump associated with the flow line for controlling the flow rate of the formation fluid into the flow line;

(c) a collection chamber having a first chamber for receiving the formation fluid from the flow line and a second chamber for maintaining a predetermined pressure in the first chamber;

(d) a first fluid flow control device between the flow line and the first chamber for controlling the flow of the fluid from the flow line into the first chamber; and (e) a second fluid flow control device for controlling the fluid flow from the flow line into the second chamber; and (f) a pressure sensor associated with the first chamber for detecting the pressure in the first chamber.

15. The apparatus according to claim 14, wherein each of the flow control devices is an electrically controllable valve.

16. The apparatus according to claim 15 further comprising a control circuit for controlling the operation of the pump and the flow control devices.

17. The apparatus according to claim 16, wherein the second chamber is in fluid communication with the wellbore fluid.

18. The apparatus according to claim 17 further having a third fluid flow control device associated with the second chamber for controlling the fluid communication between the second chamber and the wellbore fluid.

19. The apparatus according to claim 18 further having a fluid analysis device that cooperates with the control circuit for determining when the fluid in the flow line is substantially free from any mud filtrates.

20. The apparatus according to claim 19, wherein the control circuit determines the pressure in the flow line from a pressure sensor associated therewith and in response thereto controls the operation of the pump so as to maintain the flow line pressure above the bubble point of the fluid in the flow line.

21. The apparatus according to claim 20, wherein the probe is placed in a packer which is adapted to be sealingly urged against the selected formation to thereby allow the formation fluid to flow into the probe.

22. The apparatus according to claim 21, wherein the formation tester is conveyable in the wellbore by a wireline.

23. A formation testing system for testing and retrieving a formation fluid from a selected formation around a wellbore having a wellbore fluid therein, comprising:

(a) a downhole tool conveyable in the wellbore from a surface location, said tool having
  (i) a packer chamber for retrieving the formation fluid into a flow line,
  (ii) a pressure sensor for determining the pressure of the fluid in the flow line, and
  (iii) a pump associated with the flow line for controlling the flow rate of the formation fluid into the flow line;

(b) a fluid collection chamber having
  (i) a chamber divided by a piston therein into a first chamber for receiving the formation fluid from the flow line and a second chamber for maintaining a back pressure on the piston,
  (ii) a first fluid flow control device between the flow line and the first chamber for controlling the flow of the fluid from the flow line into the first chamber,
  (iii) a pressure sensor associated with the first chamber for determining the pressure in the first chamber, and
  (iv) a second fluid flow control device between the flow line and the second chamber for controlling the fluid flow from the flow line into the second chamber;

(c) a control circuit within the tool, said control circuit receiving signals from the pressure sensor associated with the first chamber and in response thereto controlling the fluid flow control device to control the fluid flow into the first chamber; and (d) a surface control unit for communicating with the control circuit and for providing command signals to the control circuit according to programmed instructions provided to the surface control unit.

24. The apparatus according to claim 23 further having a two-way telemetry for providing two-way data communication between the control circuit and the surface control unit.

25. The apparatus according to claim 24, wherein the control circuit in cooperation with the surface control unit determines when the fluid in the flow line is substantially free from mud filtrates and opens the first fluid flow control device to allow such fluid to enter into the first chamber during the retrieval of the formation fluid from the selected formation.

26. The apparatus according to claim 24, wherein after collection of a desired amount of the formation fluid into the first chamber, the control circuit in cooperation with the surface control unit causes the first fluid flow control device to close, the second fluid flow control device to open, operates the pump so as to inject wellbore fluid from the flow line into the second chamber in a manner that will maintain the back pressure at a predetermined level.

27. A method for collecting a formation fluid from a selected wellbore formation surrounding a wellbore, comprising:

(a) conveying a formation tester in the wellbore, said formation tester having a device for retrieving the formation fluid and a chamber having a first chamber for collecting the retrieved formation fluid and a second chamber for providing a predetermined back pressure to the first chamber;

(b) setting the device for retrieving the formation fluid adjacent the selected formation;

(c) retrieving the formation fluid from the selected formation;

(d) determining when the retrieved formation fluid is substantially free from mud filtrates; and (e) collecting the substantially mud filtrate free formation fluid into the first chamber of the chamber while maintaining a predetermined back pressure in the second chamber.

28. The method of claim 27, wherein the back pressure in the second chamber during the collection of the fluid in the first chamber is the hydrostatic pressure of the wellbore.

29. The method of claim 28, wherein the hydrostatic pressure in the second chamber is obtained by maintaining the second chamber in fluid communication with the wellbore fluid during the collection of the formation fluid in the first chamber.

30. The method of claim 29 further comprising the step of injecting the wellbore fluid into the second chamber to maintain the back pressure at a predetermined level after the collection of the formation fluid in the first chamber.

* * * * *